US007513794B2

(12) United States Patent
Lange

(10) Patent No.: US 7,513,794 B2
(45) Date of Patent: Apr. 7, 2009

(54) CLAMP/PLUG CONNECTOR FOR THROUGH-WALL CONNECTION HAVING WEDGE-SHAPED ATTACHMENT

(75) Inventor: Oliver Lange, Damme (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 47 days.

(21) Appl. No.: 10/552,104

(22) PCT Filed: Mar. 4, 2004

(86) PCT No.: PCT/EP2004/002152

§ 371 (c)(1),
(2), (4) Date: Oct. 3, 2005

(87) PCT Pub. No.: WO2004/088798

PCT Pub. Date: Oct. 14, 2004

(65) Prior Publication Data

US 2006/0194473 A1 Aug. 31, 2006

(30) Foreign Application Priority Data

Apr. 4, 2003 (DE) ..... 103 15 661

(51) Int. Cl.
*H01R 13/73* (2006.01)

(52) U.S. Cl. ..... 439/555; 439/557

(58) Field of Classification Search ..... 439/555, 439/557, 552, 556, 554, 558, 717, 560
See application file for complete search history.

(56) References Cited

U.S. PATENT DOCUMENTS

| | | | | |
|---|---|---|---|---|
| 4,165,146 A | | 8/1979 | Snyder | 339/128 |
| 4,543,557 A | * | 9/1985 | Schaefer | 337/196 |
| 4,560,227 A | * | 12/1985 | Bukala | 439/557 |
| 4,591,228 A | * | 5/1986 | Vasseur | 439/715 |
| 4,797,123 A | * | 1/1989 | Weber | 439/717 |
| 5,044,985 A | | 9/1991 | Sheen | 439/544 |
| 5,199,896 A | * | 4/1993 | Mosquera | 439/329 |
| 5,263,871 A | * | 11/1993 | Sano | 439/157 |
| 5,449,300 A | * | 9/1995 | Yoon | 439/441 |
| 5,800,208 A | * | 9/1998 | Ishizuka et al. | 439/557 |
| 6,648,681 B2 | * | 11/2003 | Ushiro et al. | 439/557 |
| 2001/0002018 A1 | | 5/2001 | Goudal | 220/3.5 |

FOREIGN PATENT DOCUMENTS

| | | |
|---|---|---|
| DE | 36 13 681 | 6/1987 |
| DE | 43 42 512 | 6/1995 |
| DE | 198 01 260 | 7/1999 |
| DE | 199 02 805 | 8/1999 |
| DE | 202 00 974 | 5/2003 |
| EP | 1 333 544 | 8/2003 |
| WO | WO 95/16295 | 6/1995 |

OTHER PUBLICATIONS

International Search Report for PCT/EP2004/002152 (3 pages).

* cited by examiner

*Primary Examiner*—Truc T Nguyen
*Assistant Examiner*—Xuong M Chung-Trans
(74) *Attorney, Agent, or Firm*—Darby & Darby

(57) ABSTRACT

A clamp/plug connector for through-wall connection includes a clamp housing of an insulating material. A locking element is provided for attaching the clamp housing to a wall. A pivotable actuation wedge is connected as a single piece to the locking element.

20 Claims, 3 Drawing Sheets

CLAMP/PLUG CONNECTOR FOR THROUGH-WALL CONNECTION HAVING WEDGE-SHAPED ATTACHMENT

The present invention relates to a clamp for through-wall connection or a plug connector for through-wall connection having a locking element for attaching the clamp housing, which is made of insulating material, to a device or housing wall.

BACKGROUND

In clamps or plug connectors for through-wall connection in a one-piece embodiment, it is known that these are inserted up to a fixed stop on their housing, which is made of insulating material, into a housing wall opening and the wall thickness of the housing wall is then clamped on the housing wall rear, using a wedge, a screw, or a spreading component, between the fixed stop and the wedge or the screw.

It is known from DE 36 13 681 C1 that, in particular in a two-part insulating material housing, an external part may have an internal part pushed into it in such a way that the two housing halves may clamp a sheet metal wall of a device front, which is provided with a through opening, between them, the external part and the internal part having elements which may engage with one another, so that a sturdy connection arises between the two housing halves and the through clamp becomes a fixed clamp housing. This fixed through clamp, which is particularly sufficient for individual connections, is not sufficient for the rougher plug connector connection having high plugging and pulling forces as well as jerky tilting and removal motions.

A through-wall clamp made of a plate-shaped insulating material body for electrical conductors, which also has a stop for applying the through clamp to the wall passage to position the through-wall clamp, the device wall having a springy U-shaped catch strap having two springy, pre-tensioned catch legs, which receives a housing wall between a stop on a clamp and the U-shaped catch strap, which may be pushed on as an additional part, is known from DE 198 01 260 A1. Since this clamp is a clamp for through-wall connection for individual connections of electrical conductors, when actuating the conductor contact means, only slight forces act on the attachment point of the clamp for through-wall connection even in the cutout of the wall through opening. This clam for through-wall connection having its attachment does not have sufficient connection stability for a plug connector having high plugging and pulling forces and for the back-and-forth movements frequently used in handling by a tool or by a plug when removing or plugging in the tool or a plug connector, so that in this case as well, in the event of rough handling, both the clamp connection of the PE connector and also the additional clamping using the clamping strap do not ensure sufficient attachment of the clamp for through-wall connection.

SUMMARY OF THE INVENTION

It is an object of the present invention to provide a clamp/plug connector for through-wall connection in regard to the attachment to a housing wall in such a way as to save space and components. Additional, alternative, objects of the present invention are set forth in the following sentences: The clamp/plug connector for through-wall connection is to be mounted or dismounted as rapidly and easily as possible without screws, rivets, or the like, the insertion and attachment of the entire clamp for through-wall connection being made possible from one wall side of the device. The cutout tolerances of the wall passage opening and also the wall thickness of the housing or device wall itself are not have any influence on the interference fit of the through clamp and/or the through plug connector. According to an object, additional screw holes or threaded holes in the housing wall are to be dispensed with, whose individual parts, such as screws, rivets, and other included attachment parts for the interference fit of the clamp or plug connector for through-wall connection may thus advantageously be dispensed with. The one-piece clamp/plug connector for through-wall connection provided for an object is to have a good interference fit in the housing wall opening not only for the action of an actuation tool for connecting an electrical conductor or against the plugging or pulling forces of a plug, but rather also clamp/plug connectors for through-wall connection which are made of arbitrarily many disk-shaped assembled insulating material housings are to have a secure interference fit in the through opening of the housing wall.

In an embodiment variation for connection of plug connectors on both sides in particular, this attachment is to be significantly improved in relation to the related art, because a significant load acts on the attachment elements through plugging and pulling forces. This type of attachment is to have nearly the same attachment effect as a screw connection because of this.

The present invention provides a clamp/plug connector for through-wall connection. The clamp/plug connector includes a clamp housing including an insulating material; a locking element for attaching the clamp housing to a wall; and a pivotable actuation wedge connected as a single piece to the locking element.

The achievement of the object allows secure attachment of a one-piece clamp/plug connector for through-wall connection, or a clamp/plug connector for through-wall connection preferably conceived in disk construction, having extremely solid seating in the housing wall with a special design of the attachment means. The attachment provided for one-piece connection housings has an advantageous effect for a row of plate-shaped connection housings if these are engaged with one another into a block from a freely selectable number of plate-shaped single housings. For this purpose, the attachment means are engaged as a component to the outer insulation material housings of the block or plugged on via a dovetail guides and thus solidly connected before the wall mounting.

The attachment means are shaped in this case so that they are conceived as a springy, narrow catch means and are attached laterally to the narrow side of a clamp or plug connector for through-wall connection. The U-shape provided allows precisely fitted plugging in of the resulting connection block. When the clamp or plug connector for through-wall connection is plugged into the opening of a device or housing wall, this movement is only allowed up to a stop on the clamp an/or plug connector housing.

An effective attachment is achieved by a wedge lock according to the present invention. This is provided on both sides of the one-piece or disk-shaped connection housing block. The constructive design of the locking element offers the possibility in particular of mounting the clamp or plug connector for through-wall connection from one side of the device or housing wall. For this purpose, the locking element is implemented as a U-shaped strap. The external dimensions of the clamping legs of the strap, which spring outward, are dimensioned so that there is a slight excess dimension in relation to the height of the wall cutout. When this U-shaped strap is plugged through, it is pressed through the edges of the opening, so that a slight clamping arises even in the pluggedin state. This is advantageous because tolerance variations of the through opening may thus be compensated for. For the precise positioning of the strap, an inner curve is provided on its outer side toward the edge of the through opening, into which an edge of the housing wall may snap because of the U-shaped strap, which bends elastically outward. This snapping of the attachment element is supported according to the present invention by a wedge-shaped pivot element, which is connected in one piece to the U-shaped support strap via a narrow connection web 21 of the legs of the U-shaped support strap. The wedge-shaped pivot element may be moved back-and-forth elastically around this narrow connection web, the pivot element being dimensioned in such a way that upon pivoting of the wedge-shaped pivot element, the free end of the wedge clamps the second strap end on the inner side of the housing opening. For this purpose, the contact surface of the pivot element toward the bottom side of one leg of the U-shaped strap is dimensioned in such a way that with increasing pivot angle, the clamp between the contact surfaces is increased. With increasing pivot angle, the pivot element acts, through its one-piece connection to the first leg of the U-shaped support strap, like a wedge between the contact legs and presses them outward against the inner edge of the wall opening.

In order that this wedge effect does not come loose automatically in case of use due to the wedge automatically pivoting back in the event of vibrations or other influences, slip safeties are provided on its contact surface and on the interior of the support strap which counteract automatic detachment. The embodiment of the locking wedge allows rapid mounting without tools, the wedge being able to be pressed to catch audibly between the legs of the support strap using the fingers. To remove the wedge when the clamp or plug connector for through-wall connection is removed, because of the interference fit of this wedge, an insertion opening for a screwdriver blade is provided. Depending on how solidly this wedge element is pressed between the legs of the support strap, a light or solid seating of the strap and therefore of the entire clamp/plug connector for through-wall connection may thus be achieved.

BRIEF DESCRIPTION OF THE DRAWINGS

In the following, the present invention will be described on the basis of an exemplary embodiment and the figures associated therewith.

DETAILED DESCRIPTION

Figure 1:
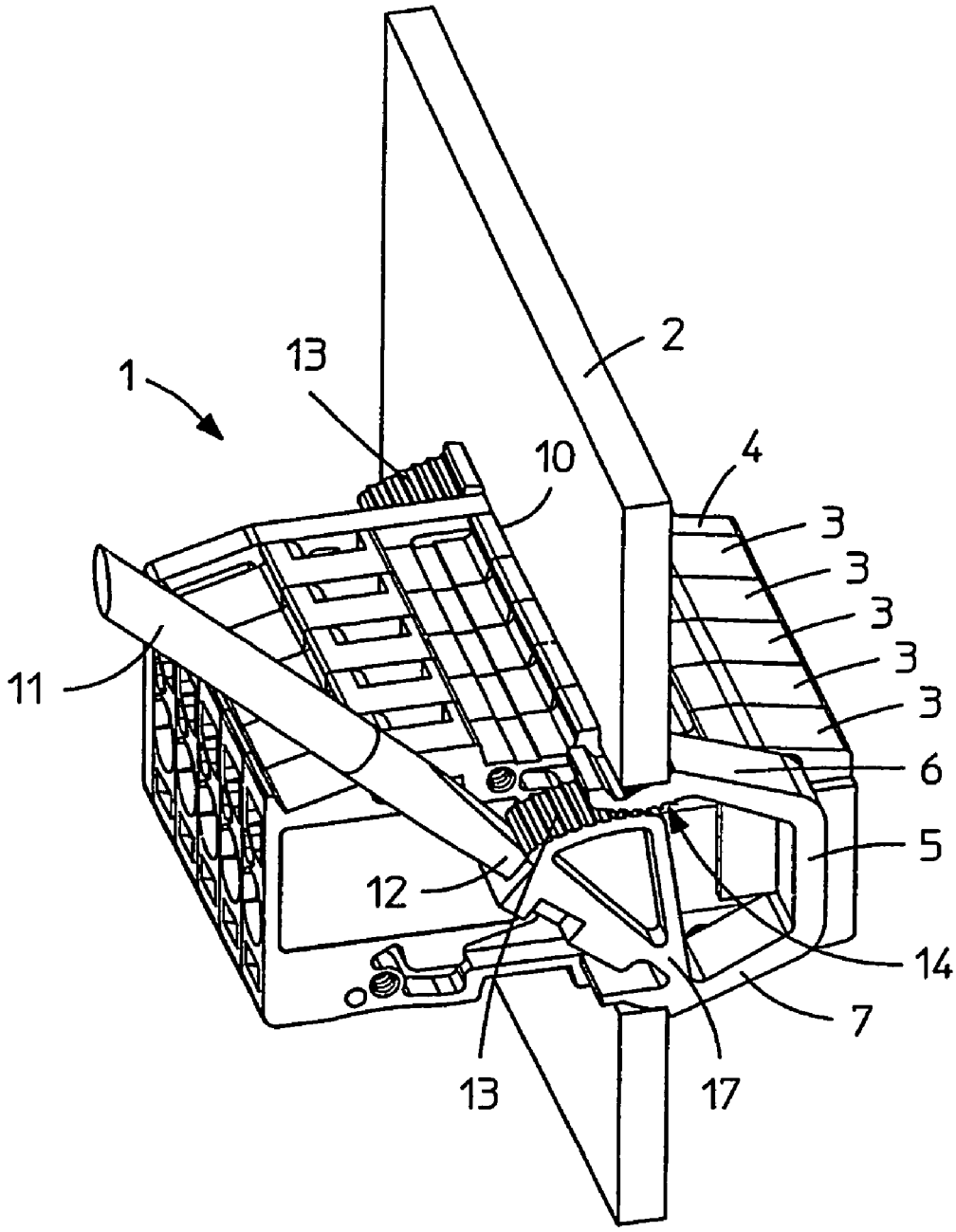
FIG. 1 shows an exemplary arrangement in a clamp/plug connector for through-wall connection in a perspective view, which was assembled from plate-shaped connection housings.

As an example, FIG. 1 illustrates the arrangement of a clamp/plug connector for through-wall connection 1, comprising plate-shaped connection elements 3, the plate-shaped connection elements 3 each having connection points in different designs for electrical conductors using spring force or screw technology, for example. These plate-shaped connection elements 3 are attached to one another using catch means or dovetail guides in this case, so that they are held together to form a solid connection block. The number of the connection elements 3 may advantageously be selected freely here according to the application. This clamp/plug connector for through-wall connection 1 is, in a preparation for insertion into a through opening of a device or housing wall 2, whose dimensions are predefined, provided laterally with a locking element 5, which advantageously produces a solid connection to the clamp/plug connector for through-wall connection by engagement using known catch means or by plugging in using known dovetail guides. For an interference, fit of the clamp/plug connector for through-wall connection 1, an arrangement on both sides as shown in FIG. 1 is necessary. In order that, upon the attachment of the locking element 5, catch means of the last plate-shaped connection element 3 projecting on one side of the clamp/plug connector for through-wall connection 1 in plate-shaped construction do not interfere, a terminal element 4 is engaged, which in turn has any arbitrary known catch or plug means for a solid connection between the locking element 5 and the clamp/plug connector for through-wall connection 1. In this case, the catch or plug means are positioned in such a way that the locking element 5 may only be attached in one alignment to the clamp/plug connector for through-wall connection 1. This clamp/plug connector for through-wall connection 1 thus completed is subsequently inserted into the opening of the housing or device wall 2. For this purpose, the clamp/plug connector 1 for through-wall connection has height dimensions smaller than the height of the through opening. In order that the clamp/plug connector for through-wall connection 1 may assume a predefined position in relation to the wall passage, a stop 10 is provided in the insertion direction on the individual plate-shaped connection elements 3, which prevents the clamp/plug connector for through-wall connection 1 from being inserted completely through.

Figure 2:
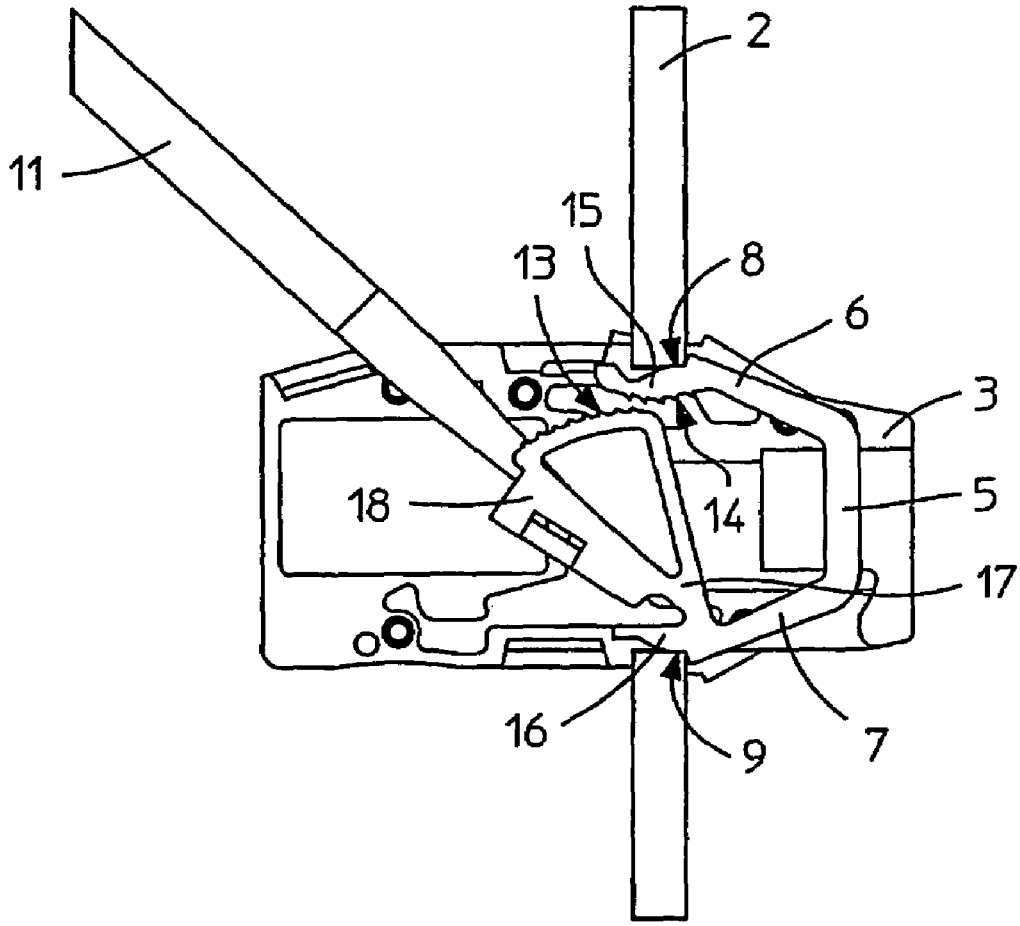
FIG. 2 shows a locking element in the open state.

The locking element 5 is implemented as essentially U-shaped as shown in FIG. 2, the particular legs 6, 7 of the engaged locking element 5 still projecting through the opening of the housing or device wall 2 in the stop position of the clamp/plug connector for through-wall connection 1. The installer may determine the correct final position of the clamp/plug connector for through-wall connection 1 in that the locking elements 5 snap behind the housing or device wall 2 shortly before the final position, which is predefined by the stop 10. For this purpose, undercuts 8, 9 are provided on the edges 19, 20 of the side of the legs 6, 7 facing toward the wall opening, which allow the legs 6, 7, which are pressed together in the insertion procedure, to expand. Because of the clamp parts 14, 15 projecting into the wall passage region, which are formed from the end pieces of the legs 6, 7, support of the legs 6, 7 of the support strap of the locking element 5 is ensured.

The locking element 5 has a wedge-shaped actuating part 18 between its legs 6, 7. This is connected to the clamp legs 7 via a flexible connection web 17. The actuating part 18 may be actuated easily in the X direction through thumb pressure. To open the wedge connection in the Y direction, the actuating part 18 has an insertion opening 12 for an actuating tool, a screwdriver blade 11 being advantageous for this purpose. Therefore, the actuating wedge 18 may be moved out of the clamped position between the first leg 6 and second leg 7 of the support strap of the locking element 5 via its flexible support web 16. In this case, the side of the wedge-shaped actuating part 17 facing toward the second clamp part 15 is constructed in such a way that as the actuating part 18 pivots increasingly, its contact surface 13 approaches the back of the clamp part 15 having its contact surface 14 and this contact surface enters a press fit with the counter contact surface in its pivoted final position. In this case, the actuating part 18 is supported via the flexible support web 17 on the first leg 7. In order that the wedge connection does not detach automatically by pivoting back, ribs aligned transversely to the actuating direction are provided on the contacting surfaces 13 of the actuating part 18 and the corresponding clamp part surface 14 of the clamp part 15, for example, which mutually exchange.

Figure 3:
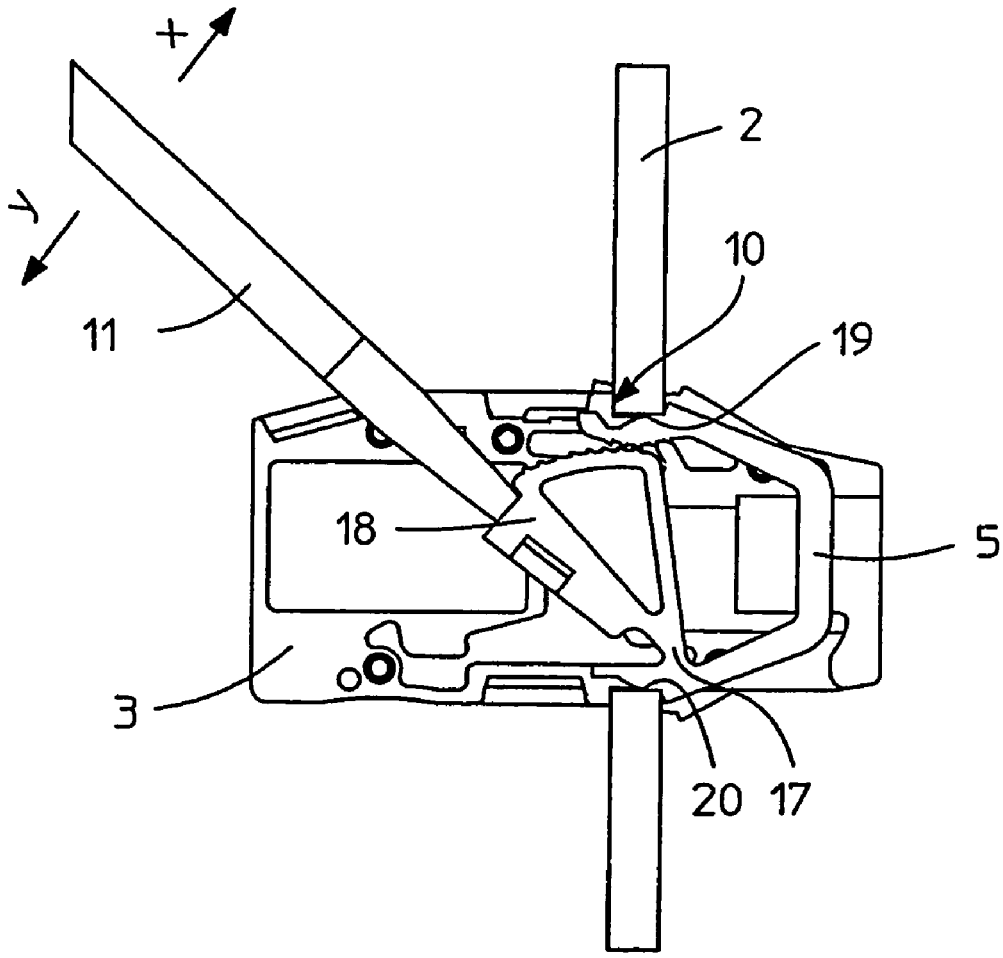
FIG. 3 shows a locking element in the clamped position.

A pivot position of the actuating part 18 is shown in FIG. 3, in which the contacting surfaces 13 and 14 are engaged. The actuating part 18 is thus clamped between the leg 7 having the support web 17 and the first clamp part 15, the surfaces 13, 14 facing toward one another pressing against one another. The actuating part 18 is driven in this case like a wedge into the free space between the first and second legs 6, 7 of the support strap of the locking element 5, which are supported via the clamp part 15, 16 on the inner edge of the wall opening. When the clamp/plug connector for through-wall connection 1 is removed, the actuating part 18 is pivoted out of the U-shaped support strap of the locking element 5 with the aid of an actuating tool 11, the transverse teeth on the surfaces 13, 14 facing toward one another being overcome because of the press fit. By pressing together the clamp parts 15, 16 projecting through the wall opening, the clamp for through-wall connection 1 may be removed.

The invention claimed is:

1. A connector for through-wall connection, comprising:

a clamp housing;

a locking element for attaching the clamp housing to a wall; and a pivotable actuation wedge connected as a single piece to the locking element, wherein:

the locking element includes a pair of clamp parts configured to respectively engage upper and lower inner edges of a through opening of the wall, and the actuation wedge is configured to pivot so as to press the clamp parts respectively against the upper and lower inner edges of the through opening so as to support the locking element on the inner edges.

2. The connector as recited in claim 1 wherein the clamp parts are configured to project through the wall.

3. The connector as recited in claim 1 wherein the clamp housing includes a plurality of plate-shaped contact housings attached to one another, and further comprising a terminal element.

4. The connector as recited in claim 1 wherein the locking element includes a flexible connection web disposed on a clamp leg, the actuation wedge being connected to the clamp leg via the flexible connection web.

5. The connector as recited in claim 1 wherein the actuation wedge includes an insertion opening configured to receive an actuation tool.

6. The connector as recited in claim 1 wherein the locking element includes first and second flexible clamp legs elastically movable toward each other so as to automatically engage an opening of the wall upon an insertion of the plug connector in the opening.

7. The connector as recited in claim 1 wherein the locking element includes first and second flexible clamp legs elastically movable toward each other so as to automatically engage an opening of the wall upon an insertion of the plug connector in the opening.

8. The connector as recited in claim 1 wherein the wall is a wall of a device or housing.

9. A connector for through-wall connection, comprising:

a clamp housing including an insulating material;

a locking element for attaching the clamp housing to a wall; and a pivotable actuating wedge connected as a single piece to the locking element, wherein:

the locking element includes a clamp part configured to engage an inner edge of a through opening of the wall, and a first surface of the actuation wedge and a second surface of a side of the clamp part facing the actuation wedge each include a respective slip safety device.

10. The connector as recited in claim 9 wherein each of the respective slip safety devices includes respective teeth.

11. The connector as recited in claim 9 wherein the clamp part is configured to project through the wall.

12. The connector as recited in claim 9 wherein the clamp housing includes a plurality of plate-shaped contact housings attached to one another, and further comprising a terminal element.

13. The connector as recited in claim 9 wherein the locking element includes a flexible connection web disposed on a clamp leg, the actuation wedge being connected to the clamp legs via the flexible connection web.

14. The connector as recited in claim 9 wherein the actuation wedge includes an insertion opening configured to receive an actuation tool.

15. The connector as recited in claim 9 wherein the locking element includes first and second flexible clamp legs elastically movable toward each other so as to automatically engage an opening of the wall upon an insertion of the connector in the opening.

16. The connector as recited in claim 9 wherein the wall is a wall of a device or housing.

17. The connector as recited in claim 9 wherein the respective slip safety devices of the actuation wedge and the side of the clamp part are configured to engage each other.

18. A connector for through-wall connection, comprising:

a clamp housing;

a locking element for attaching the clamp housing to a wall; and a pivotable actuation wedge connected as a single piece to the locking element, wherein:

the locking element includes a clamp part configured to engage an inner edge of a through opening of the wall, a surface of the actuation wedge is configured to press against a side of the clamp part facing the actuation wedge, and the clamp housing includes a plurality of plate-shaped contact housings attached to one another, and further comprising a terminal element.

19. A connector for through-wall connection, comprising:

a clamp housing including a selectable number of plate-shaped contact housings attached to one another;

a terminal element attached to a first of the plate-shaped contact housings;

a first locking element for attaching the clamp housing to a wall with a first pivotable actuation wedge connected to the first locking element, the first locking element attached to the terminal element; and a second locking element for attaching the clamp housing to a wall with a second pivotable actuation wedge connected to the second locking element, the second locking element being attached to a second of the plate-shaped contact housings so as to be disposed at a variable distance from the first locking element, the variable distance being a function of the selectable number of plate-shaped contact housings.

20. The connector as recited in claim 17 wherein the side of the clamp part includes a first surface that is opposite the second surface and configured to engage the inner edge of the through opening of the wall.

* * * * *